US007004413B2

(12) United States Patent
Langlois

(10) Patent No.: US 7,004,413 B2
(45) Date of Patent: Feb. 28, 2006

(54) GRINDER CUTTER TOOTH AND ANVIL ASSEMBLY

(76) Inventor: Michel Langlois, De Bernières, Repentigny, QC (CA) J6A 7X2

( * ) Notice: Subject to any disclaimer, the term of this patent is extended or adjusted under 35 U.S.C. 154(b) by 87 days.

(21) Appl. No.: 10/428,081

(22) Filed: May 2, 2003

(65) Prior Publication Data

US 2004/0217223 A1 Nov. 4, 2004

(51) Int. Cl.
*B02C 8/18* (2006.01)

(52) U.S. Cl. ..... 241/242; 241/294; 241/300

(58) Field of Classification Search ..... 241/242, 241/243, 294, 300
See application file for complete search history.

(56) References Cited

U.S. PATENT DOCUMENTS 3,473,742 A 10/1969 Montgomery
3,642,214 A 2/1972 Blackwell, Jr.
4,162,770 A 7/1979 Lewis
5,060,875 A * 10/1991 McBride ..... 241/242
5,100,070 A 3/1992 Montgomery
5,524,839 A 6/1996 Schade et al.
5,873,534 A * 2/1999 Shinn ..... 241/294
6,517,020 B1 * 2/2003 Smith ..... 241/294
6,520,440 B1 * 2/2003 Ragnarsson ..... 241/294

* cited by examiner

*Primary Examiner*—Mark Rosenbaum

(57) ABSTRACT

A grinder tooth for use with a rotatable breaker ring part of a grinder, the breaker ring has a breaker head protruding radially from the ring outer peripheral surface for carrying the grinder tooth. The grinder tooth includes a blade holder, a shank extending from the blade holder and a blade releasably attached to the blade holder. The blade defines at least two grinding edges. The blade and holder are configured and sized so that the blade and holder peripheral surfaces are substantially in register with each other when the blade is attached to the holder. The blade and the holder are also configured and sized so that either one of the at least two grinding edges may be positioned radially outwardly by rotating the grinder tooth about the shank longitudinal axis allowing either one of the at least two grinding edges to be selectively used for grinding.

41 Claims, 9 Drawing Sheets

GRINDER CUTTER TOOTH AND ANVIL ASSEMBLY

FIELD OF THE INVENTION

The present invention relates to the general field of grinder tools and is particularly concerned with a grinder cutter tooth and anvil assembly.

BACKGROUND OF THE INVENTION

Industrial grinders and shredders have become essential equipments in many processing and manufacturing facilities. These equipments are also commonly referred to as hammermills, pulverizer or hogs. Initially used mostly to grind bark removed from raw logs in sawmills and pulpmills, they are now widely used for the size reduction of a variety of materials including dry solids.

Conventional grinders are frequently used for grinding raw logs which can then be burned as fuel or sold as horticultural mulch. The grinders are also typically used for grinding a wide range of other materials including tree stumps, slash from logging operations, land fill trash, soft metals such as aluminum and copper scraps, used automobile and light truck tires, construction dunnage and even some food products such as grinding applies into mash in preparation for making apple cider.

Whatever the use, the grinders conventionally employ a plurality of hammers pivoted on a motor driven rotor. The hammers are adapted to shred or crush materials which are fed through the grinder. Typically, conventional grinders use so-called "bell"-shaped hammers and so-called "bowtie"-shaped hammers. Both of these conventional types of hammers are formed as one piece from a homogeneous material typically through a casting and/or machining manufacturing process.

Although grinders have been in common use for an extended period of time, they nevertheless suffer from at least one main drawback. Indeed, the hammers or teeth of the rotor are arranged with respect to the rotor so that they encounter virtually all of the compressive and impact forces. Accordingly, they are subject to rapid wear and deterioration. The deterioration of the teeth, in turn, leads to gradual loss of efficiency and may even potentially lead to break down of the grinder.

The grinder teeth are hence replaced periodically. This, in turn, leads to relatively large operational costs. Indeed, not only must the grinder be halted during replacement procedures but the teeth which are made out of a relatively strong material are quite expensive. Because of the relatively high costs, in practice, the grinder teeth are seldom replaced with the required frequency to maintain good cutting characteristics.

In order to reduce the costs associated with maintenance of the grinder teeth, some users have resorted to resurfacing the cutting edges of the teeth by hard face welding metal to the teeth or sharpening the latter. Typically, the resurfacing operation necessitates that the teeth be removed from the rotor, transported to a resurfacing device and transported back to the grinding machine where they are reconnected to the rotor.

The extensive time delays encountered in the resurfacing process are problematic and onerous. It is thus often necessary to maintain a complete set of spare sharpened teeth at the grinding site to minimize the downtime of the grinder. In some instances, this may prove to be difficult. For example, in situations wherein the grinders are portable and transported to various locations, maintaining a supply of extra cutting teeth may even prove to be impossible.

The conventional grinders also typically include anvils or similar hard structures defining grinding apertures through which the teeth pass at each rotation of the rotor. Although the teeth are subjected to greater compressive and impact forces than the anvils, the latter nevertheless eventually also suffer from wear and deterioration. The deterioration of the anvil surfaces eventually leads to less than optimal rotor cutting characteristics for a given power input to the rotor. Similarly to grinder teeth replacement, grinder anvil replacement requires lengthy and costly procedures.

Hence, the prior art seems to have failed in providing a satisfying solution to the problems associated with grinder teeth wear. Furthermore, the prior art seems to have mostly neglected the possible contribution of the wear of grinder anvils to the loss of efficiency of the grinder machinery. Accordingly, there exists a need for an improved grinder cutter tooth and an improved grinder anvil.

SUMMARY OF THE INVENTION

It is an object of the present invention to provide an improved grinder cutter tooth and an improved grinder anvil.

In accordance with the present invention, there is provided a grinder tooth for use with a rotatable breaker ring part of a grinder, said breaker ring defining a peripheral ring outer surface and at least one breaker head protruding radially and at least partially from said ring outer peripheral surface for carrying said grinder tooth, said breaker head defining a radially outermost head outer surface, said breaker head also defining a head leading surface and a head trailing surface extending substantially radially between said ring and head outer surfaces respectively in a circumferentially leading and trailing position relative to each other, said breaker head having a head channel extending therethrough between said head leading and trailing surfaces, said grinder tooth comprising: a blade holder, said blade holder defining a blade receiving surface, an opposed shank attachment surface and a holder peripheral surface extending therebetween; a shank, said shank defining a shank longitudinal axis, a shank proximal end attached to said shank attachment surface, a longitudinally opposed shank distal end and a shank intermediate section extending therebetween, said shank extending from said shank attachment surface in a substantially perpendicular relationship relative thereto, said shank being configured and sized for extending through said head channel when said shank attachment surface abuttingly contacts said head leading surface; a blade, said blade having a blade grinding surface, a blade attachment surface and a blade peripheral surface extending therebetween, said blade defining a blade normal axis extending in a substantially perpendicular relationship relative to said blade attachment surface, the intersection of said blade grinding and peripheral surfaces defining at least two grinding edges; a tooth-to-head releasable attachment means for releasably attaching said grinder tooth to said breaker head with said shank extending through said head channel and said shank attachment surface abuttingly contacting at least a portion of said head leading surface; a blade-to-holder releasable attachment means for releasably attaching said blade to said holder with said blade attachment surface engaging at least a portion of said blade receiving surface; said blade and holder being configured and sized so that said blade and holder peripheral surfaces are substantially in register with each other when said blade is attached to said holder; said blade and said holder being configured and sized so that either one of said at least two grinding edges may be positioned radially outwardly by rotating said grinder tooth about said shank longitudinal axis allowing either one of said at least two grinding edges to be selectively used for grinding.

In accordance with the present invention there is also provided, in combination, a grinder and a grinder tooth for use with a rotatable breaker ring part of said grinder, said breaker ring defining a peripheral ring outer surface and at least one breaker head protruding radially and at least partially from said ring outer peripheral surface for carrying said grinder tooth, said breaker head defining a radially outermost head outer surface, said breaker head also defining a head leading surface and a head trailing surface extending substantially radially between said ring and head outer surfaces respectively in a circumferentially leading and trailing position relative to each other, said breaker head having a head channel extending therethrough between said head leading and trailing surfaces, said grinder also including at least one anvil mounted so as to cooperate with said grinder tooth for grinding grindable material squeezed between said anvil and said grinder tooth when said breaker ring rotates, said grinder tooth comprising: a blade holder, said blade holder defining a blade receiving surface, an opposed shank attachment surface and a holder peripheral surface extending therebetween; a shank, said shank defining a shank longitudinal axis, a shank proximal end attached to said shank attachment surface, a longitudinally opposed shank distal end and a shank intermediate section extending therebetween, said shank extending from said shank attachment surface in a substantially perpendicular relationship relative thereto, said shank being configured and sized for extending through said head channel when said shank attachment surface abuttingly contacts said head trailing surface; a blade, said blade having a blade grinding surface, a blade attachment surface and a blade peripheral surface extending therebetween, said blade defining a blade normal axis extending in a substantially perpendicular relationship relative to said blade attachment surface, the intersection of said blade grinding and peripheral surfaces defining at least two grinding edges; a tooth-to-head releasable attachment means for releasably attaching said grinder tooth to said breaker head with said shank extending through said head channel and said shank attachment surface abuttingly contacting at least a portion of said head trailing surface; a blade-to-holder releasable attachment means for releasably attaching said blade to said holder with said blade attachment surface engaging at least a portion of said blade receiving surface; said blade and holder being configured and sized so that said blade and holder peripheral surfaces are substantially in register with each other when said blade is attached to said holder; said blade and said holder being configured and sized so that either one of said at least two grinding edges may be positioned radially outwardly by rotating said grinder tooth about said shank longitudinal axis allowing either one of said at least two grinding edges to be selectively used for grinding.

Advantages of the present invention include that the proposed grinder cutter tooth and grinder anvil, at least in part, overcome the aforementioned inadequacies of the prior art devices by allowing the same cutter tooth and the same anvil to be used for a greater length of time.

The proposed grinder tooth and anvil thus reduces both the service time and the costs associated with tooth and anvil replacement. Also, the proposed grinder cutter teeth and anvils are adapted to allow for optimization of the rotor cutting characteristics for a given power input to the grinder rotor.

Still furthermore, the proposed grinder teeth and grinder anvils are designed so as to be readily mountable and adaptable to various types of grinders without requiring special tooling or manual dexterity. Also, the proposed grinder teeth and grinder anvils are designed so as to be retrofittable to a plurality of conventional primary grinders.

Still further, the proposed invention is designed so as to provide grinder teeth and grinder anvils that will conform to conventional forms of manufacturing so as to produce a grinder teeth and anvils that will be economically feasible, long lasting and relatively trouble free in operation.

The foregoing has outlined some of the advantages of the present invention. These advantages should construed to be merely illustrative of some of the more prominent features and applications of the invention. Many other beneficial results can be obtained by applying the disclosed invention in a different manner or modifying the invention within the scope of the disclosure. Particularly, with regards to the use of the invention disclosed herein, it should not be construed as being limited to an hammer or tooth assembly for attachment to the rotor of a rotary grinder, but should include applications to any material crushing apparatus and the like.

BRIEF DESCRIPTION OF THE DRAWINGS

Various embodiments of the present invention will now be disclosed, by way of example, in reference to the following drawings in which.

DETAILED DESCRIPTION

Figure 4:
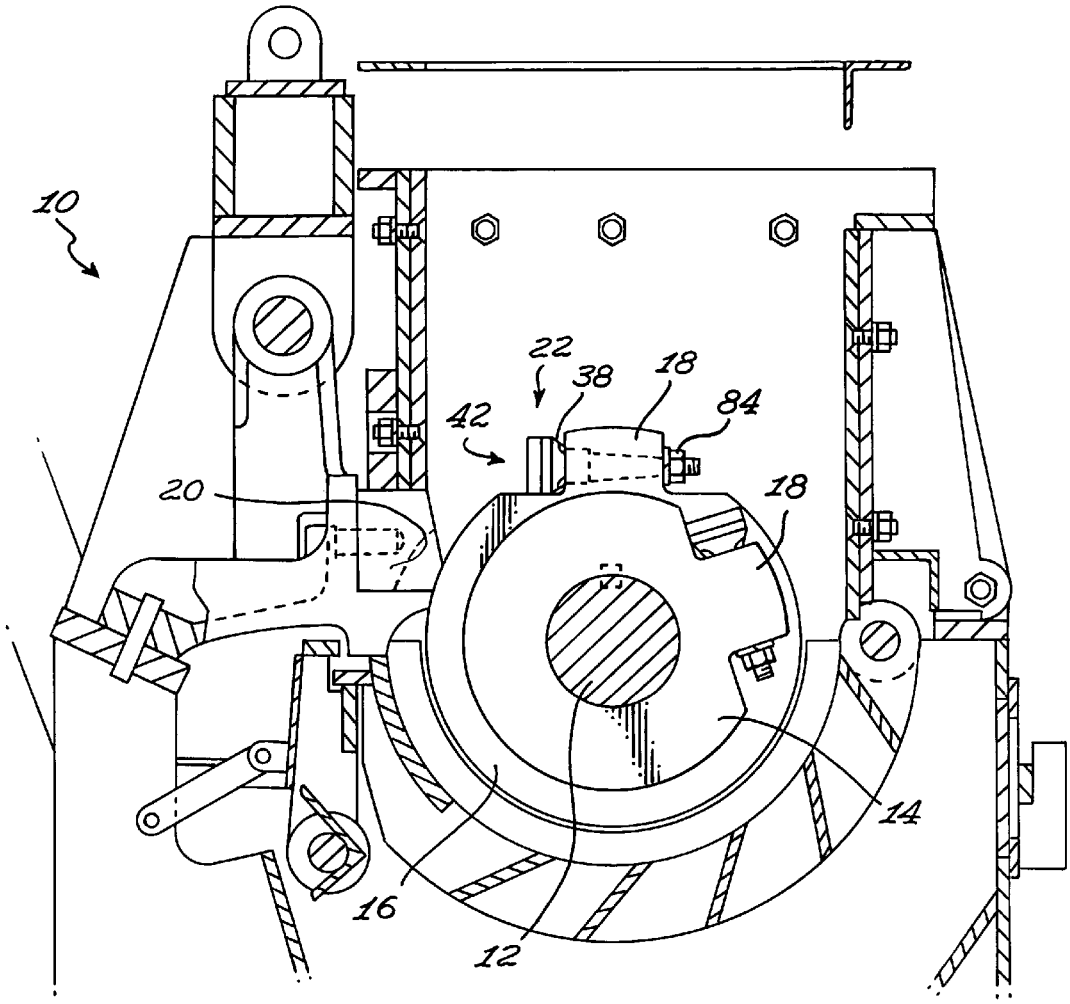
FIG. 4, in a partial transversal cross-sectional view, illustrates part of a conventional grinder provided with grinder teeth and anvils both in accordance with embodiments of the present invention.

Referring to FIG. 4, there is shown a grinder 10 including a rotor 12 rotatable about the corresponding rotor axis. The rotor 12 includes a plurality of alternately small and large diameter breaker rings 14, 16. Each breaker ring 14, 16 carries at least one breaker head 18. In turn, a tooth assembly 22 is carried by each breaker head 18.

The tooth assemblies 22 and corresponding breaker heads are arranged to pass adjacent anvils 20. Typically, larger anvils 20 define relatively small spaces for the passage of the breaker heads 18 and teeth assemblies 22 of smaller diameter breaker rings 14 while smaller anvils 20 define larger spaces for the breaker heads 18 and teeth assembly 22 or larger breaker rings 16.

Typically, if desired, smaller diameter breaker rings 14 and their corresponding breaker heads 18 can be displaced inwardly of the outer periphery of larger diameter breaker rings 16 so that the larger anvils 20 protrude into the spaces between the larger diameter breaker rings 16. This assures that the ground up material is small enough to pass through the correspondingly defined spaces.

Figure 1:
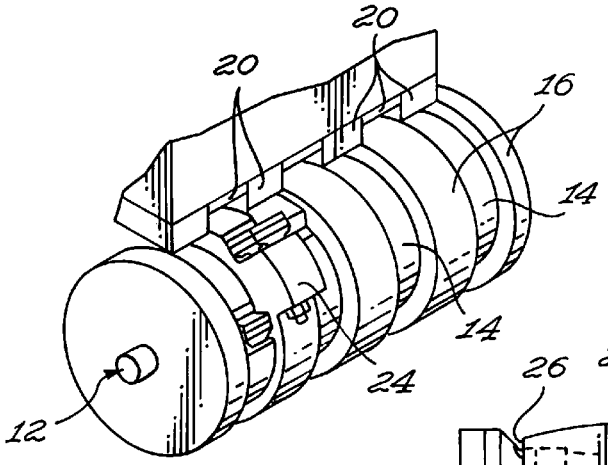
FIG. 1, in a partial perspective view with sections taken out, illustrates a rotor and anvil assembly part of a conventional grinder.
Figure 2:
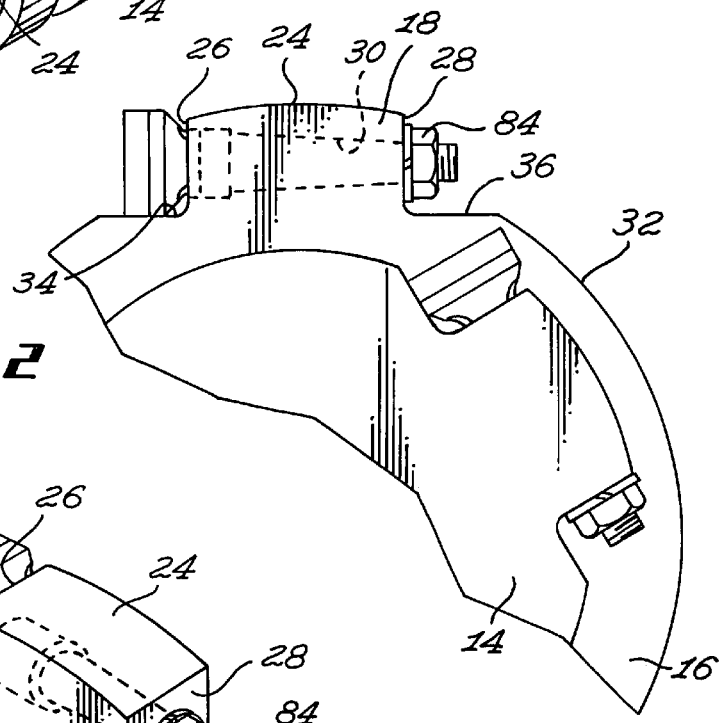
FIG. 2, in a partial side elevational view with sections taken out, illustrates a pair of grinder teeth in accordance with an embodiment of the present invention, the grinder teeth being shown mounted on breaker rings part of the rotor assembly shown in FIG. 1.
Figure 3:
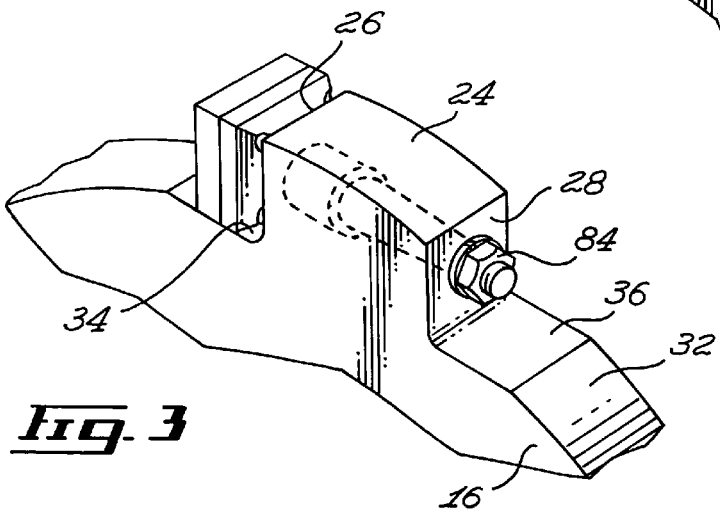
FIG. 3, in a rear perspective view with sections taken out, illustrates a grinder tooth in accordance with an embodiment of the present invention, mounted on a section a breaker ring.

As is best shown in FIGS. 2 and 3, the breaker heads 18 typically protrude radially outwardly from the centre of the rotor 12. Each breaker head 18 defines a radially outermost and typically rounded head outer surface 24. Each breaker head 18 also defines a head leading surface 26 and a head trailing surface 28. Both the head leading and trailing surfaces 26, 28 extend substantially radially between the ring outer surface 30 and the head outer surface 24 respectively in a circumferentially leading and trailing position relative to each other.

Each breaker head 18 have a head channel 30 extending therethrough between the head leading and trailing surfaces 26, 28. To emphasize the shape of each breaker head 18 without requiring the breaker head 18 to extend a large distance from the breaker ring outer surface 30, each breaker ring 30 may be undercut to form corresponding leading and trailing recesses 34, 36 respectively adjacent the head leading and trailing surfaces 26, 28 of each breaker head 18.

Figure 5:
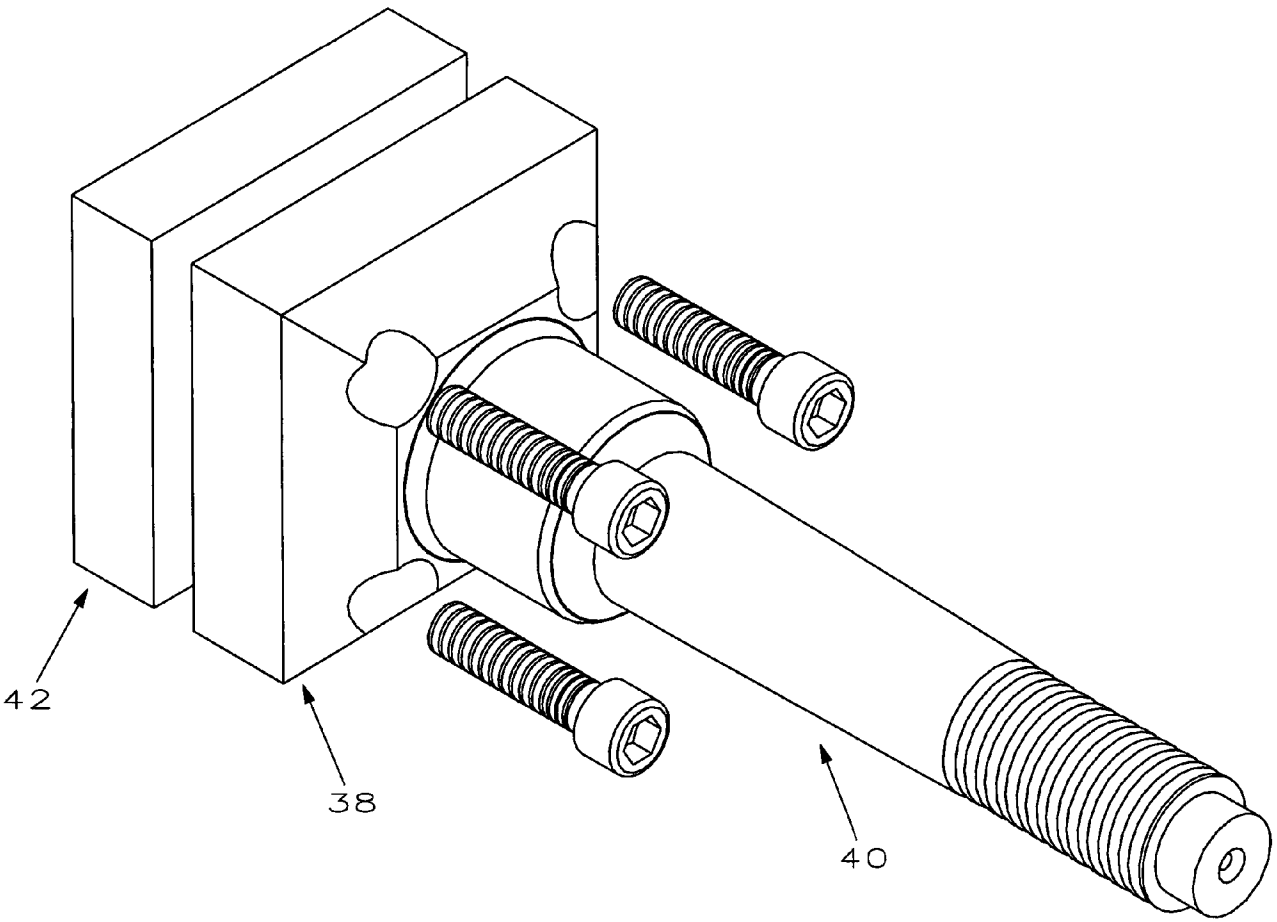
FIG. 5, in a partially exposed view, illustrates part of a grinder tooth in accordance with an embodiment of the present invention.
Figure 6:
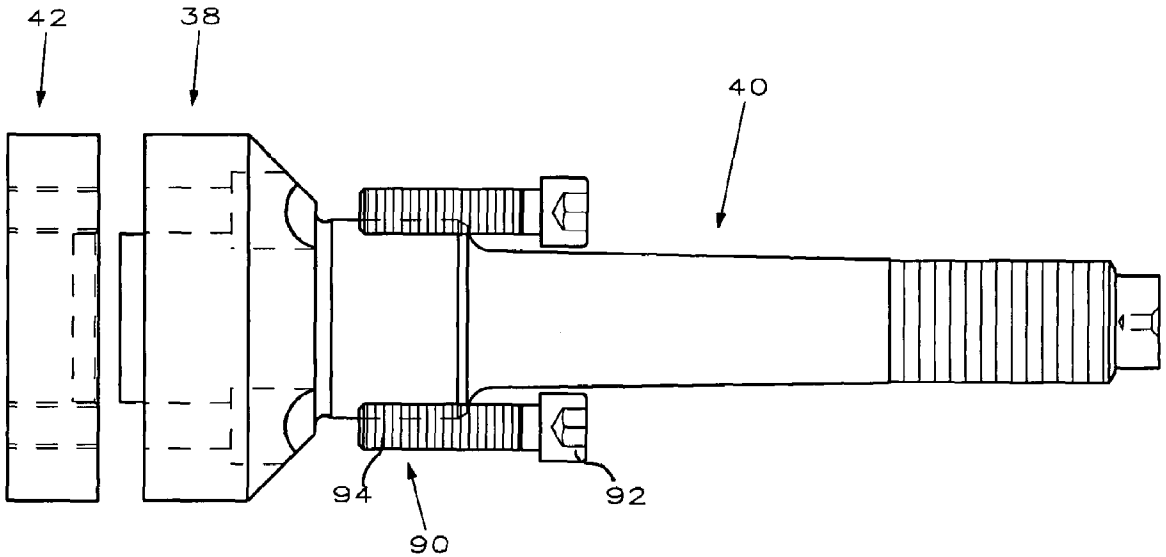
FIG. 6, in a partial exploded side elevational view, illustrates part of a grinder tooth in accordance with an embodiment of the present invention.
Figure 7:
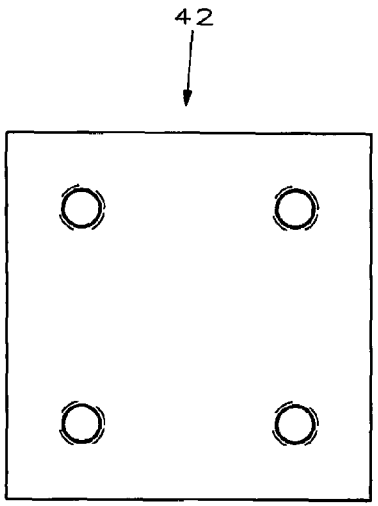
FIG. 7, in a front elevational view illustrates a blade part of the grinder tooth shown in FIGS. 5 and 6.

As illustrated more specifically in FIGS. 5 through 7, each grinder tooth assembly 22 includes a blade holder 38, a shank 40 and a blade 42. As illustrated more specifically in FIGS. 8 through 11, each blade holder 38 defines a blade receiving surface 44, an opposed shank attachment surface 46 and a holder peripheral surface 48 extending therebetween.

The shank 40 defines a shank longitudinal axis 50, a shank proximal end 52 attached to the shank attachment surface 46, a longitudinally opposed shank distal end and a shank intermediate section 56 extending therebetween. The shank 40 extends from the shank attachment surface 46 in a substantially perpendicular relationship relative thereto. As shown in FIGS. 2 through 4, the shank 40 is configured and sized for extending through head channel 30 when the shank attachment surface 46 abuttingly contacts the head leading surface 26.

As illustrated more specifically in FIGS. 12 through 15, the blade 42 has a blade grinding surface 58, a blade attachment surface 60 and a blade peripheral surface 62 extending therebetween. The blade 42 defines a blade normal axis 64 extending in a substantially perpendicular relationship relative to the blade attachment surface 60. The intersection of the blade grinding and peripheral surfaces 58, 62 defines at least two and typically four grinding edges 66.

Each grinder tooth assembly 22 also includes a tooth-to-head releasable attachment means for releasably attaching the grinder tooth assembly 22 to the breaker head 18 with the shank 40 extending through the head channel 30 and the shank attachment surface 46 abuttingly contacting at least a portion of the head leading surface 26. The grinder tooth assembly 22 further includes a blade-to-holder releasable attachment means for releasably attaching the blade 42 to the holder 38 with the blade attachment surface 60 engaging at least a portion of the blade receiving surface 44.

The blade 42 and holder 38 are configured and sized so that the blade and holder peripheral surfaces 62, 48 are substantially in register with each other when the blade 42 is attached to the holder 38. Also, the blade 42 and the holder 38 are configured and sized so that either one of at least two and preferably four grinding edges 66 may be positioned radially outwardly by rotating the grinder tooth assembly 22 about the shank longitudinal axis 50 so as to allow either one of at least two and preferably four grinding edges 66 to be selectively used for grinding.

Typically, when the blade 42 only defines two grinding edges 66, the grinding edges 66 are generally circumferentially opposed relative to each other. As shown more specifically in FIG. 12, the blade 42 typically has substantially the general configuration of a rectangular parallelepiped. As shown more specifically in FIG. 5, typically both the blade 42 and the holder 38 have substantially the general configuration of a rectangular parallelepiped. Hence, typically, both the blade receiving and attachment surfaces 44, 60 have a substantially square-shaped configuration.

Preferably, the blade receiving and attachment surfaces 44, 60 are substantially of the same size so that the blade receiving and attachment surfaces 44, 60 substantially cover each other when in an abutting relationship with each other. In order for the grinder tooth assembly 22 to be retrofitted in some existing grinders 10, both the blade receiving and attachment surfaces 48, 60 may typically, although by no means exclusively, have a size of approximately 3 inches by 3 inches.

Typically, the blade receiving and attachment surfaces 44, 60 define an inter-engaging substantially complementary tongue and groove combination for preventing slidable relative movement between the blade receiving and attachment surfaces 44, 60 when the blade receiving and attachment surfaces 44, 60 are in abutting contact with each other.

As shown in FIGS. 5 through 15, the tongue and groove combination typically includes a tongue 68 extending from the blade receiving surface 44 and a corresponding groove 70 formed in the blade attachment surface 60. The tongue 68 and groove 70 are configured and sized so that the tongue 68 is substantially fittingly inserted in the groove 70 when the blade receiving and attachment surfaces 44, 60 are in abutting contact with each other.

Typically, although by no means exclusively, both the tongue 68 and groove 70 have a generally disc-shaped configuration. Typically, although by no means exclusively, the tongue 68 and groove 70 have a diameter of approximately between 1 and 2 inches when the blade receiving and attachment surfaces 48, 60 have a size of approximately 3 inches by 3 inches.

As illustrated more specifically in FIGS. 8 through 11, the holder peripheral surface 48 typically defines a peripheral leading section 72 extending substantially perpendicularly from the peripheral edges of the blade receiving surface 44 and a peripheral trailing section 74 extending between the peripheral leading section 72 and the shank 40. The peripheral trailing section 74 typically has a substantially frusto-pyramidal configuration tapering inwardly from the leading edges 76 of the peripheral trailing section 74 towards the shank attachment surface 46 so that the shank attachment surface 46 is smaller than the blade receiving surface 44.

Typically, although by no means exclusively, the thickness of the peripheral trailing section is substantially between one-half and two-thirds of the thickness of the peripheral leading section 72. Typically, although by no means exclusively, the thickness of the peripheral leading section has a value of approximately one inch while the thickness of the peripheral trailing section 74 has a value of approximately one-half of an inch. Also, typically, the area of the shank attachment surface 46 is substantially between one and three-quarters that of the blade receiving surface 44.

Typically, although by no means exclusively, the area of the shank attachment surface 46 is approximately 4 square inches while that of the blade receiving surface 44 is approximately 9 square inches. It should be understood that the hereinabove mentioned values are given for illustrative purposes only and that these values could vary greatly without departing from the scope of the present invention.

Figure 10:
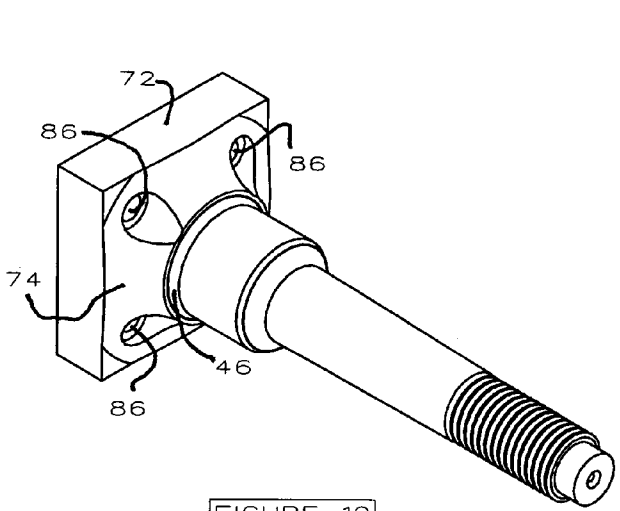
FIG. 10, in a rear perspective view, illustrates the blade holder and shank shown in FIG. 8.
Figure 11:
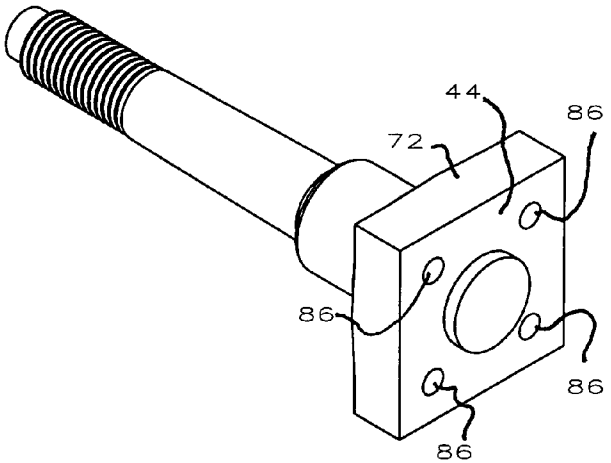
FIG. 11, in a front perspective view, illustrates the blade holder and shank combination shown in FIGS. 8 through 10.
Figure 8:
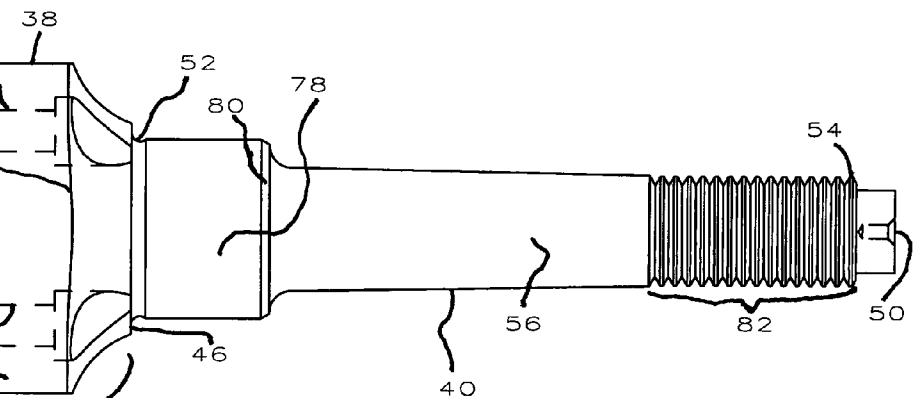
FIG. 8, in a side elevational view, illustrates a blade holder and shank both part of a grinder tooth in accordance with an embodiment of the present invention.
Figure 9:
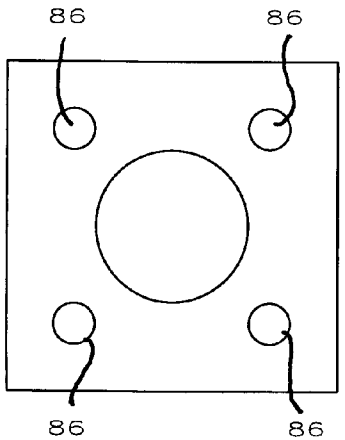
FIG. 9, in a front elevational view, illustrates a blade holder part of the blade holder and shank combination shown in FIG. 8.
Figure 12:
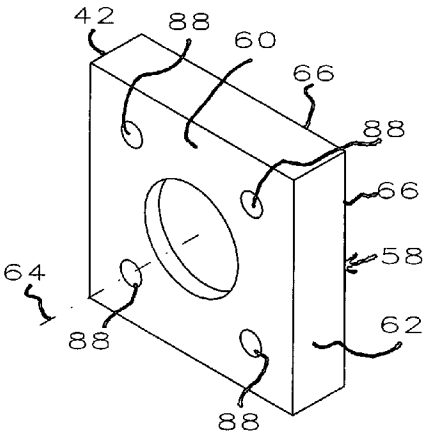
FIG. 12, in a rear perspective view, illustrates a blade part of a grinder tooth in accordance with an embodiment of the present invention.
Figure 15:
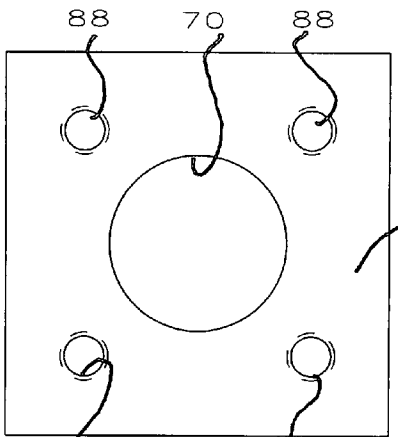
FIG. 15, in a rear elevational view, illustrates the blade shown in FIGS. 12 through 14.
Figure 14:
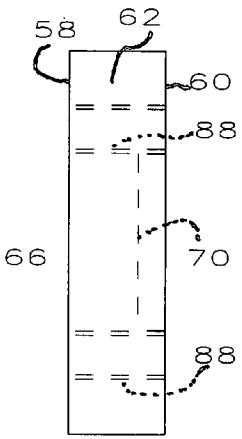
FIG. 14, in a side elevational view, illustrates the blade shown in FIGS. 12 and 13.
Figure 13:
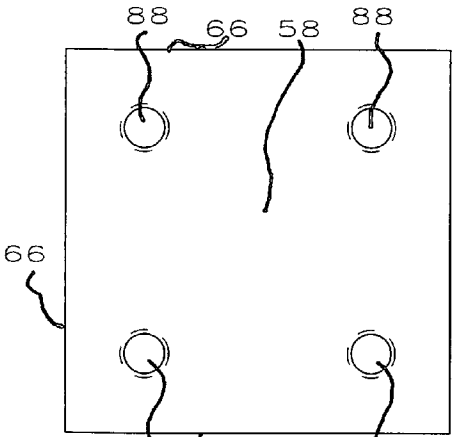
FIG. 13, in a front elevational view, illustrates the blade in shown in FIG. 12.

As shown more specifically in FIGS. 8, 10, and 11, the shank intermediate section 56 typically defines a shank reinforcement portion 78 positioned adjacent the shank proximal end 52. The diameter of the reinforcement portion 78 is typically greater than that of the remainder of the shank intermediate section 56. The reinforcement portion 78 typically has a substantially cylindrical configuration. Also, the reinforcement portion 78 is typically provided with an annular circumferential groove 80 located substantially adjacent the shank proximal end 52. Typically, the remainder of the shank intermediate portion 56 has a substantially frusto-conical tapering in a direction leading towards the shank distal end 54.

The tooth-to-head releasable attachment means typically includes a shank thread 82 formed on the shank 40 adjacent the shank distal end 54. The shank 40 is configured and sized for extending through the head channel 30 with the shank thread 82 protruding from the breaker head 18 when the shank attachment surface 46 abuttingly contacts the head leading surface 26 so that the shank thread 82 may be threadably engaged with a conventional nut component 84 for securing the grinder tooth assembly 22 to the breaker head 18.

As illustrated more specifically in FIGS. 8 through 11, the blade-to-holder releasable attachment means typically includes at least one and preferably four holder channels 86 extending through the holder 38 between the blade receiving surface 44 and the shank attachment surface 46.

As illustrated more specifically in FIGS. 12 through 15, the blade-to-holder releasable attachment means also includes at least one and preferably four corresponding blade channels 88 extending at least partially through the blade 42. The holder channels 86 and corresponding blade channel 88 are configured and sized so as to be substantially in register and in a substantially co-linear relationship with each other when the blade receiving and attachment surfaces 34, 60 are in abutting contact with each other in an attachment configuration. The holder and blade channels 86, 88 typically allow insertion therein of an elongated attachment component such as a bolt when the blade receiving and attachment surfaces 44, 60 are in abutting contact with each other in the attachment configuration.

Typically, the blade channels 88 are provided with a blade channel thread formed therein. Accordingly, as shown more specifically in FIGS. 5 and 6, elongated attachment component typically takes the form of an attachment bolt 90 having a bolt head 92 and a threaded bolt shaft 94. The holder and blade channels 86, 88 are adapted to receive the bolt 90 with at least a portion of the threaded bolt shaft 94 threadably engaging the blade channel thread when the blade receiving and attachment surfaces 44, 60 are in the attachment configuration.

As illustrated more specifically in FIGS. 8 through 11, each holder channel 86 is typically positioned so as to extend from a position located substantially adjacent the intersection of the peripheral trailing section 74 and the shank attachment surface 46 to a position located on the blade receiving surface 44 located intermediate a corner portion of the latter in the tongue 68.

Typically, the tongue and groove combination and the blade-to-holder releasable attachment means allows at least two and preferably four of the grinding edges 66 to be positioned radially outwardly by rotating the blade 42 about the blade normal axis 64, allowing either one of the two or four grinding edges 66, to be selectively used for grinding.

Figure 16:
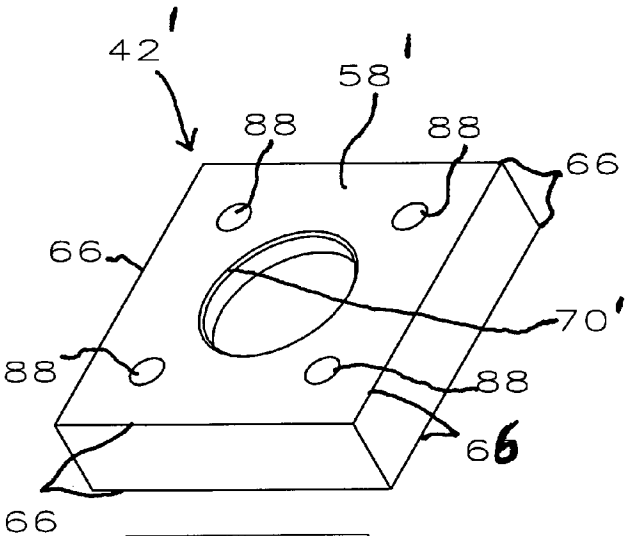
FIG. 16, in a rear perspective view, illustrates a blade in accordance with an alternative embodiment of the present invention.
Figure 18:
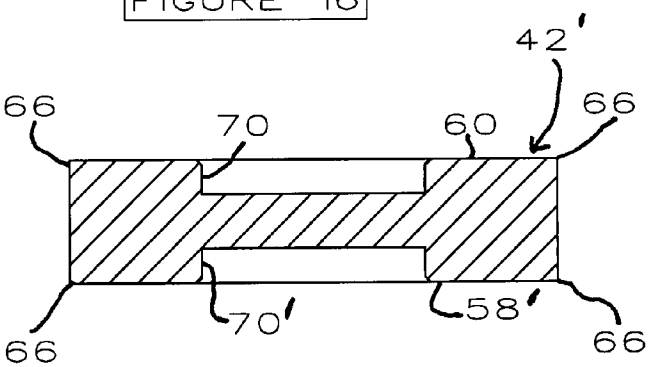
FIG. 18, in a transversal cross-sectional view, illustrates the blade shown in FIGS. 16 and 17.
Figure 17:
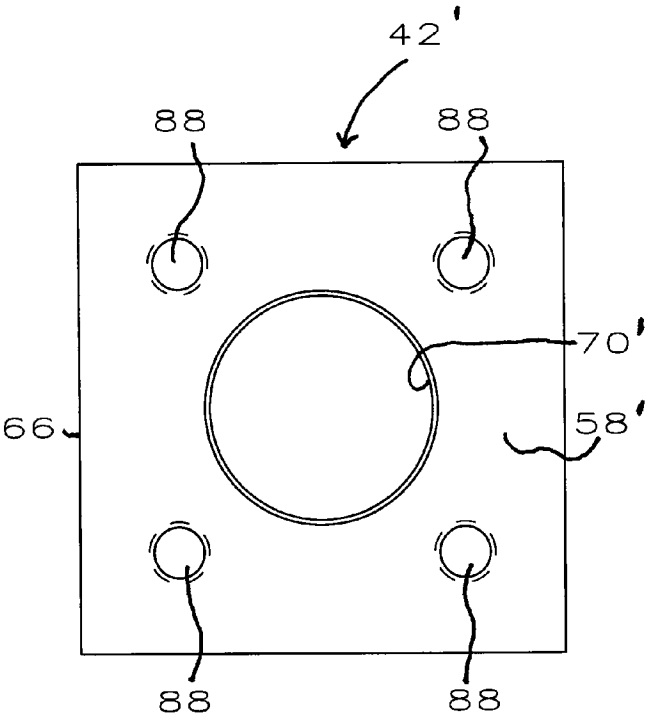
FIG. 17, in a rear elevational view, illustrates the blade shown in FIG. 16.

Referring now more specifically to FIGS. 16 through 18, there is shown a blade 42' in accordance with an alternative embodiment of the present invention. The blade 42' is substantially similar to the blade 42 and, hence, similar reference numerals will be used to denote similar components.

One of the main differences between the blades 42 and 42' resides in that the blade grinding surface 58' of the blade 42' is also provided with a groove 70' formed therein for substantially fittingly receiving the tongue 68. Hence, the blade 42' may be flipped over so that either one of the blade attachment and grinding surfaces 58', 60 may be positioned in a leading or trailing position relative to the other for being selectively used respectively to attach a blade 42' to the holder 38 and to grind.

Figure 20:
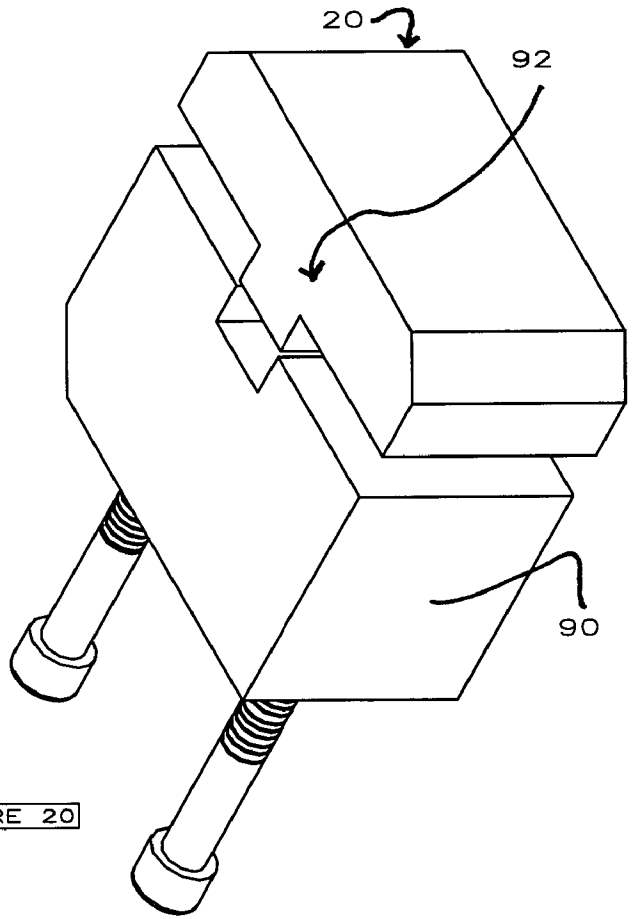
FIG. 20, in a front exploded view, illustrates the anvil assembly shown in FIG. 19.
Figure 19:
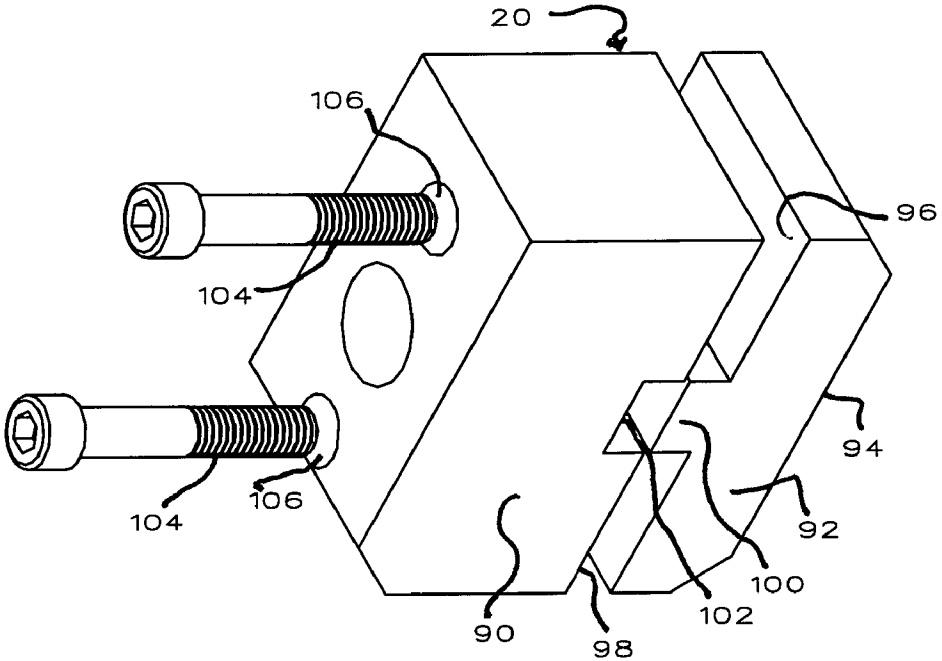
FIG. 19, in a partial rear exploded view, illustrates an anvil assembly in accordance with an embodiment of the present invention.
Figure 21:
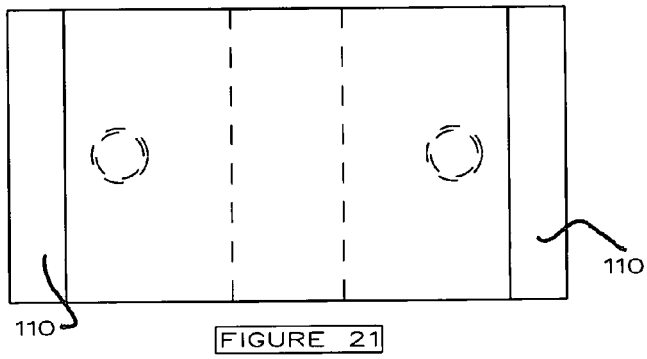
FIG. 21, in a top view, illustrates an anvil insert part of the anvil assembly shown in FIGS. 19 and 20.
Figure 24:
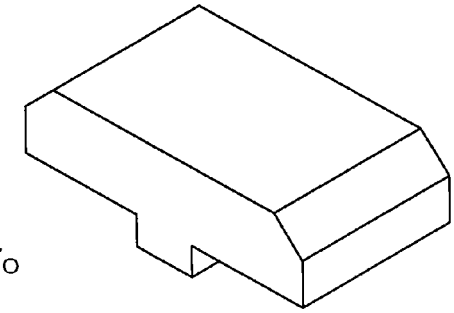
FIG. 24, in a front perspective view, illustrates the anvil insert shown in FIGS. 21 through 23.
Figure 22:
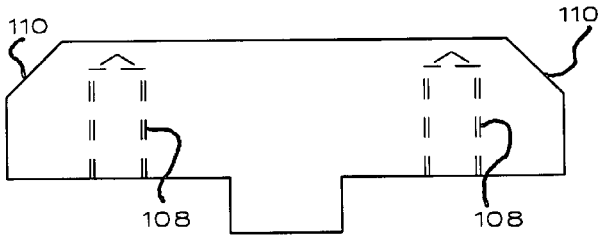
FIG. 22, in a side elevational view, illustrates the anvil insert shown in FIG. 21.
Figure 25:
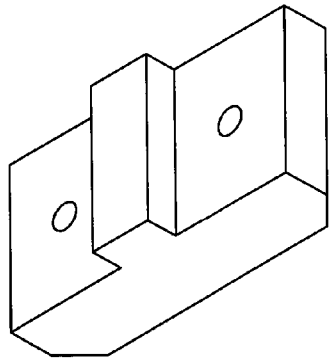
FIG. 25, in a bottom perspective view, illustrates the anvil insert shown in FIGS. 21 through 24.
Figure 23:
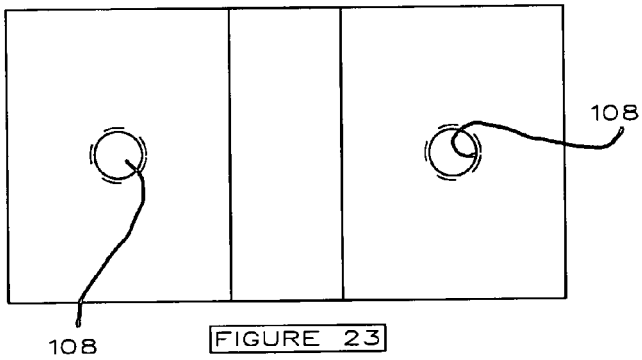
FIG. 23, in a bottom view, illustrates the anvil insert shown in FIGS. 21 and 22.

Referring now more specifically to FIGS. 19 and 20, there is shown an anvil 20, in accordance with an embodiment of the present invention. The anvil 20 includes an anvil base 91 for attachment to the grinder 10 and an anvil insert 93 for attachment to the anvil base (91). The anvil insert (93) is adapted to cooperate with the grinder tooth assembly 22 for grinding the grindable material by contacting the grindable material when the breaker rings 14, 16 are rotated. Preferably, the anvil insert and base (93, 91) are configured and sized so as to allow the anvil insert (93) to be positioned in at least two distinct orientations relative to the anvil base (91) when attached thereto.

Typically, the anvil insert (93) defines a material contacting surface 95 for contacting the grindable material during grinding thereof and an opposed base contacting surface 96 for contacting the anvil base (91) when the anvil insert (93) is attached to the anvil base (91). The anvil base (91) defines an insert contacting surface 98 for contacting the anvil insert (93) when the anvil insert (93) is attached to the anvil base (91).

The insert and base contacting surfaces 98, 96 together define an inter-engaging substantially complementary tongue and groove combination for preventing slidable relative movement between the insert and base contacting surfaces 98, 96 when the insert and base contacting surfaces 98, 96 are in abutting contact with each other. Typically, the tongue and groove combination includes a tongue 100 extending from the base contacting surface 96 and a corresponding groove 102 formed in the insert contacting surface 98. The tongue 100 and the groove 102 are configured and sized so that the tongue 100 is substantially fittingly inserted in the groove 102 when the insert and base contacting surfaces 98, 96 are in abutting contact with each other. Typically, although by no means exclusively, both the tongue 100 and the groove 102 have a substantially parallelepiped-shaped configuration. The tongue and groove combination also allows the anvil insert (93) to be positioned in at least two distinct orientations relative to the anvil base (91).

In operation, the material to be ground up is typically allowed to fall by gravity down into contact with the rotor 12. The rotor 12 is typically driven to a rapid rotation by a suitable driving means.

The material will be engaged by the blades 42 as the rotor 12 rotates. The grinding edges 66 of each blade 42 will typically bite into the material and sever in wedge chunks the material away from the main body of the material. The grinder tooth assemblies 22 typically pass adjacent the anvils 20 on each revolution with the rotor 12, so that if any particles of the material moving with the tooth assemblies 22 happens to be larger than the spaces between the anvils 20 and the breaker rings 14, 16, the tooth assembly 22 will break up these particles so that they will pass through the spaces. Typically, the side surfaces and top surfaces of the blades 42 function with a scissors motion with the sides of the anvils 20 to sever and grind the material at this point.

When a given grinding edge 66 becomes dulled, the blade 42 while attached to the holder 38 may be rotated by rotating the grinder tooth assembly 22 about the shank longitudinal axis 50. Hence, each blade 42 may be rotated at least three times so as to present four different cutting edge 66. The configuration and size of both the holder and blade 42 is such that, typically, the shank 40 does not have to be completely removed from the breaker channel 30 to allow rotation of the grinder teeth assembly 22 about the shank longitudinal axis 50. In some situations, it may be desirable to rotate the blade 42 relative to the holder 38; in such instances, the bolts 91 may be easily loosened to allow such rotation of the blade 42 relative to the holder 38. Hence, depending on the situation, either one or both the grinder teeth assembly 22 relative to the breaker head 18 and/or the blade 42 relative to the holder 38 may be rotated to provide a sharp and fresh blade grinding edge 66 in a radially outwardmost operational position.

The configuration and size of both the blade 42 and holder 38 not only allows for the use of four distinct grinding edges 66, but also distributes the stresses imparted on the grinder tooth assembly 22 during operation in such a way that a grinder tooth assembly 22 is able to withstand relatively high stresses for relatively long periods of time. The generally symmetrical nature of the blade 42 not only allows for suitable stress distribution but also potentially reduces manufacturing costs. The tongue and groove combination 68, 70 reduces the shearing stress on some of the bolt components. Reinforcement section 78 and its annular groove 80 produce a stress concentration at strategic locations.

In the embodiment shown in FIGS. 17 and 18, the number of available cutting edges 66 is doubled by allowing the blade 42 to be flipped over so as to further increase the usable lifetime of a given blade 42'.

The anvil base and insert (91), (93) are typically assembled together using suitable base-to-insert releasable attachment means. The base-to-insert releasable attachment means may take any suitable form such as anvil bolts 104 extending through corresponding bolt channels 106, 108 formed respectively in the anvil base and insert (91), (93).

The contacting surface 95 of the anvil insert (93) may have any suitable configuration without departing from the scope of the present invention. For example, the contacting surface (95) may be provided with bevelled edges 110 and arcuate surface (not shown) or any other suitable configuration.

I claim:

1. A grinder tooth for use with a rotatable breaker ring part of a grinder, said breaker ring defining a peripheral ring outer surface and at least one breaker head protruding radially and at least partially from said ring outer peripheral surface for carrying said grinder tooth, said breaker head defining a radially outermost head outer surface, said breaker head also defining a head leading surface and a head trailing surface extending substantially radially between said ring and head outer surfaces respectively in a circumferentially leading and trailing position relative to each other, said breaker head having a head channel extending therethrough between said head leading and trailing surfaces, said grinder tooth comprising:

a blade holder, said blade holder defining a blade receiving surface, an opposed shank attachment surface and a holder peripheral surface extending therebetween;

a shank, said shank defining a shank longitudinal axis, a shank proximal end attached to said shank attachment surface, a longitudinally opposed shank distal end and a shank intermediate section extending therebetween, said shank extending from said shank attachment surface in a substantially perpendicular relationship relative thereto, said shank being configured and sized for extending through said head channel when said shank attachment surface abuttingly contacts said head leading surface;

a blade, said blade having a blade grinding surface, a blade attachment surface and a blade peripheral surface extending therebetween, said blade defining a blade normal axis extending in a substantially perpendicular relationship relative to said blade attachment surface, the intersection of said blade grinding and peripheral surfaces defining at least two grinding edges;

a tooth-to-head releasable attachment means for releasably attaching said grinder tooth to said breaker head with said shank extending through said head channel and said shank attachment surface abuttingly contacting at least a portion of said head leading surface;

a blade-to-holder releasable attachment means for releasably attaching said blade to said holder with said blade attachment surface engaging at least a portion of said blade receiving surface;

said blade and holder being configured and sized so that said blade and holder peripheral surfaces are substantially in register with each other when said blade is attached to said holder;

said blade and said holder being configured and sized so that either one of said at least two grinding edges may be positioned radially outwardly by rotating said grinder tooth about said shank longitudinal axis while said blade remains attached to said blade holder, allowing either one of said at least two grinding edges to be selectively used for grinding.

2. A grinder tooth as recited in claim 1 wherein said grinding edges are in a generally circumferentially opposed relationship relative to each other.

3. A grinder tooth as recited in claim 1 wherein the intersection of said blade grinding and peripheral surfaces defines four grinding edges, said blade and said holder being configured and sized so that either one of said four grinding edges may be positioned radially outwardly by rotating said grinder tooth about said shank longitudinal axis allowing either one of said four grinding edges to be selectively used for grinding.

4. A grinder tooth as recited in claim 1 wherein said blade has substantially the general configuration of a rectangular parallelepiped.

5. A grinder tooth as recited in claim 1 wherein both said blade and said holder have substantially the general configuration of a rectangular parallelepiped.

6. A grinder tooth as recited in claim 5 wherein both said blade receiving and attachment surfaces have a substantially square-shaped configuration.

7. A grinder tooth as recited in claim 6 wherein said blade receiving and attachment surfaces are substantially of the same size so that said blade receiving and attachment surfaces substantially cover each other when in an abutting relationship with each other.

8. A grinder tooth as recited in claim 7 wherein both said blade receiving and attachment surfaces have a size of approximately 3 inches by 3 inches.

9. A grinder tooth as recited in claim 1 wherein said blade receiving and attachment surfaces together define an interengaging and substantially complementary tongue and groove combination for preventing slidable relative movement between said blade receiving and attachment surfaces when said blade receiving and attachment surfaces are in abutting contact with each other.

10. A grinder tooth as recited in claim 9 wherein said tongue and groove combination includes a tongue extending from said blade receiving surface and a corresponding groove formed in said blade attachment surface, said tongue and said groove being configured and sized so that said tongue is substantially fittingly inserted in said groove when said blade receiving and attachment surfaces are in abutting contact with each other.

11. A grinder tooth as recited in claim 10 wherein both said tongue and said groove have a generally disc-shaped configuration.

12. A grinder tooth as recited in claim 11 wherein both said tongue and said groove have a diameter of approximately between 1 and 2 inches.

13. A grinder tooth as recited in claim 1 wherein said holder peripheral surface defines a peripheral leading section extending substantially perpendicularly from the peripheral edges of said blade receiving surface and a peripheral trailing section extending between said peripheral leading section and said shank, said peripheral trailing section having a substantially frusto-pyramidal configuration tapering inwardly from the leading edges of said peripheral trailing section towards said shank attachment surface so that said shank attachment surface is smaller then said blade receiving surface.

14. A grinder tooth as recited in claim 13 wherein the thickness of said peripheral trailing section is substantially between one half and two-thirds of the thickness of said peripheral leading section.

15. A grinder tooth as recited in claim 14 wherein the thickness of said peripheral leading section has a value of approximately one inch while the thickness of said peripheral trailing section has a value of approximately one half of an inch.

16. A grinder tooth as recited in claim 13 wherein the area of said shank attachment surface is substantially between one and three quarters that of said blade receiving surface.

17. A grinder tooth as recited in claim 16 wherein the area of said shank attachment surface is approximately four square inches while that of said blade receiving surface is approximately nine square inches.

18. A grinder tooth as recited in claim 13 wherein the thickness of said peripheral trailing section is substantially between one half and two-thirds of the thickness of said peripheral trailing section and wherein the area of said shank attachment surface is substantially between one and three quarters that of said blade receiving surface.

19. A grinder tooth as recited in claim 1 wherein said shank intermediate section defines a reinforcement portion positioned adjacent said shank proximal end, the diameter of said reinforcement portion being greater then that of the remainder of said shank intermediate section.

20. A grinder tooth as recited in claim 19 wherein said reinforcement portion has a substantially cylindrical configuration and wherein said reinforcement portion is provided with an annular circumferential groove located substantially adjacent said shank proximal end.

21. A grinder tooth as recited in claim 20 wherein said remainder of said shank intermediate portion has a substantially frusto-conical configuration tapering in a direction leading towards said shank distal end.

22. A grinder tooth as recited in claim 1 wherein tooth-to-head releasable attachment means includes a shank thread formed on said shank adjacent said shank distal end, said shank being configured and sized for extending through said head channel with said shank thread protruding from said breaker head when said shank attachment surface abuttingly contacts said head trailing surface, whereby said shank thread is threadably engageable with a nut component for securing said grinder tooth to said breaker head.

23. A grinder tooth as recited in claim 1 wherein said blade-to-holder releasable attachment means includes at least one holder channel extending through said holder between said blade receiving surface and said shank attachment surface, said blade-to-holder releasable attachment means also including at least one corresponding blade channel extending at least partially through said blade, said at least one holder channel and said at least one corresponding blade channel being configured and sized so as to be substantially in register and in a substantially co-linear relationship with each other when said blade receiving and attachment surfaces are in abutting contact with each other in an attachment configuration; whereby said at least one holder channel and said at least one corresponding blade channel allow insertion therein of an elongated attachment component when said blade receiving and attachment surfaces are in abutting contact with each other in said attachment configuration.

24. A grinder tooth as recited in claim 23 wherein said at least one corresponding blade channel is provided with a blade channel thread formed therein; whereby said at least one holder channel and said at least one corresponding blade channel allow insertion therein of at least a portion of an attachment bolt having a bolt head and a threaded bolt shaft when said blade receiving and attachment surfaces are in abutting contact with each other in said attachment configuration, said blade channel thread allowing threadable engagement with said threaded bolt shaft.

25. A grinder tooth as recited in claim 1 wherein said blade-to-holder releasable attachment means includes four holder channels extending through said holder between said blade receiving surface and said shank attachment surface, of said holder channels being positioned in a substantially symmetrical relationship relative to each other, said blade-to-holder releasable attachment means also including four corresponding blade channel extending at least partially through said blade, said holder channels and said blade channels being configured and sized so as to be substantially in register and in a substantially co-linear relationship with each other when said blade receiving and attachment surfaces are in abutting contact with each other; whereby said holder channels and said blade channels allow insertion therein of an elongated attachment component when said blade receiving and attachment surfaces are in abutting contact with each other.

26. A grinder tooth as recited in claim 25 wherein said holder peripheral surface defines a peripheral leading section extending substantially perpendicularly from the peripheral edges of said blade receiving surface and a peripheral trailing section extending between said peripheral leading section and said shank, said peripheral trailing section having a substantially frusto-pyramidal configuration tapering inwardly from the trailing edges of said peripheral trailing section towards said shank attachment surface so that said shank attachment surface is smaller then said blade receiving surface; said blade receiving and attachment surfaces together defining an inter-engaging and substantially complementary tongue and groove combination for preventing slidable relative movement between said blade receiving and attachment surfaces when said blade receiving and attachment surfaces are in abutting contact with each other, said tongue and groove combination includes a tongue extending from said blade receiving surface and a corresponding groove formed in said blade attachment surface, said tongue and said groove being configured and sized so that said tongue is substantially fittingly inserted in said groove when said blade receiving and attachment surfaces are in abutting contact with each other; each of said holder channels being positioned so as to extend from a position located substantially adjacent the intersection of said peripheral trailing section and said shank attachment surface to a position located on said blade receiving surface located intermediate a corner portion of the latter and said tongue.

27. A grinder tooth as recited in claim 1 wherein said blade receiving and attachment surfaces together define an interengaging and substantially complementary tongue and groove combination for preventing slidable relative movement between said blade receiving and attachment surfaces when said blade receiving and attachment surfaces are in abutting contact with each other; said tongue and groove combination and said blade-to-holder releasable attachment means allowing either one of said at least two grinding edges to be positioned radially outwardly by rotating said blade about said blade normal axis allowing either one of said at least two grinding edges to be selectively used for grinding.

28. A grinder tooth as recited in claim 27 wherein the intersection of said blade grinding and peripheral surfaces defines four grinding edges, said tongue and groove combination and said blade-to-holder releasable attachment means allowing either one of said four grinding edges to be positioned radially outwardly by rotating said blade about said blade normal axis allowing either one of said four grinding edges to be selectively used for grinding.

29. A grinder tooth as recited in claim 1 wherein said blade receiving and attachment surfaces together define an interengaging and substantially complementary tongue and groove combination for preventing slidable relative movement between said blade receiving and attachment surfaces when said blade receiving and attachment surfaces are in abutting contact with each other; said tongue and groove combination including a tongue extending from said blade receiving surface and a corresponding groove formed in said blade attachment surface, said tongue and said groove being configured and sized so that said tongue is substantially fittingly inserted in said groove when said blade receiving and attachment surfaces are in abutting contact with each other; said blade grinding surface being also provided with a groove formed therein for substantially fittingly receiving said tongue; whereby said blade may be flipped over so that either one of said blade attachment and grinding surfaces may be positioned in a leading or trailing position relative to the other for being selectively used respectively to attach said blade to said holder and to grind.

30. A grinder tooth as recited in claim 29 wherein said tongue and both said grooves have a generally disc-shaped configuration.

31. In combination a grinder and a grinder tooth for use with a rotatable breaker ring part of said grinder, said breaker ring defining a peripheral ring outer surface and at least one breaker head protruding radially and at least partially from said ring outer peripheral surface for carrying said grinder tooth, said breaker head defining a radially outermost head outer surface, said breaker head also defining a head leading surface and a head trailing surface extending substantially radially between said ring and head outer surfaces respectively in a circumferentially leading and trailing position relative to each other, said breaker head having a head channel extending therethrough between said head leading and trailing surfaces, said grinder also including at least one anvil mounted so as to cooperate with said grinder tooth for grinding grindable material squeezed between said anvil and said grinder tooth when said breaker ring rotates, said grinder tooth comprising: a blade holder, said blade holder defining a blade receiving surface, an opposed shank attachment surface and a holder peripheral surface extending therebetween; a shank, said shank defining a shank longitudinal axis, a shank proximal end attached to said shank attachment surface, a longitudinally opposed shank distal end and a shank intermediate section extending therebetween, said shank extending from said shank attachment surface in a substantially perpendicular relationship relative thereto, said shank being configured and sized for extending through said head channel when said shank attachment surface abuttingly contacts said head trailing surface; a blade, said blade having a blade grinding surface, a blade attachment surface and a blade peripheral surface extending therebetween, said blade defining a blade normal axis extending in a substantially perpendicular relationship relative to said blade attachment surface, the intersection of said blade grinding and peripheral surfaces defining at least two grinding edges; a tooth-to-head releasable attachment means for releasably attaching said grinder tooth to said breaker head with said shank extending through said head channel and said shank attachment surface abuttingly contacting at least a portion of said head trailing surface; a blade-to-holder releasable attachment means for releasably attaching said blade to said holder with said blade attachment surface engaging at least a portion of said blade receiving surface; said blade and holder being configured and sized so that said blade and holder peripheral surfaces are substantially in register with each other when said blade is attached to said holder; said blade and said holder being configured and sized so that either one of said at least two grinding edges may be positioned radially outwardly by rotating said grinder tooth about said shank longitudinal axis while said blade remains attached to said blade holder allowing either one of said at least two grinding edges to be selectively used for grinding.

32. A combination as recited in claim 31 wherein the intersection of said blade grinding and peripheral surfaces defines four grinding edges, said blade and said holder being configured and sized so that either one of said four grinding edges may be positioned radially outwardly by rotating said grinder tooth about said shank longitudinal axis allowing either one of said four grinding edges to be selectively used for grinding.

33. A combination as recited in claim 31 wherein said blade receiving and attachment surfaces together define an inter-engaging and substantially complementary tongue and groove combination for preventing slidable relative movement between said blade receiving and attachment surfaces when said blade receiving and attachment surfaces are in abutting contact with each other; said tongue and groove combination and said blade-to-holder releasable attachment means allowing either one of said at least two grinding edges to be positioned radially outwardly by rotating said blade about said blade normal axis allowing either one of said at least two grinding edges to be selectively used for grinding.

34. A combination as recited in claim 33 wherein the intersection of said blade grinding and peripheral surfaces defines four grinding edges, said tongue and groove combination and said blade-to-holder releasable attachment means allowing either one of said four grinding edges to be positioned radially outwardly by rotating said blade about said blade normal axis allowing either one of said four grinding edges to be selectively used for grinding.

35. A combination as recited in claim 31 wherein said blade receiving and attachment surfaces together define an interengaging and substantially complementary tongue and groove combination for preventing slidable relative movement between said blade receiving and attachment surfaces when said blade receiving and attachment surfaces are in abutting contact with each other; said tongue and groove combination including a tongue extending from said blade receiving surface and a corresponding groove formed in said blade attachment surface, said tongue and said groove being configured and sized so that said tongue is substantially fittingly inserted in said groove when said blade receiving and attachment surfaces are in abutting contact with each other; said blade grinding surface being also provided with a groove formed therein for substantially fittingly receiving said tongue; whereby said blade may be flipped over so that either one of said blade attachment and grinding surfaces may be positioned in a leading or trailing position relative to the other for being selectively used respectively to attach said blade to said holder and to grind.

36. A combination as recited in claim 31 wherein said anvil includes an anvil base solidaly attached to said grinder and an grinder insert releasably attached to said anvil base, whereby said grinder insert is adapted to cooperated with said grinder tooth for grinding said grindable material by contacting said grindable material when said breaker ring is rotated.

37. A combination as recited in claim 36 wherein said anvil insert and base are configured and sized so as to allow said anvil insert to be positioned in at least two distinct orientation relative to said anvil base when attached thereto.

38. A combination as recited in claim 36 wherein said grinder insert defines a material contacting surface for contacting said grindable material during grinding thereof and an opposed base contacting surface for contacting said grinder base when said grinder insert is attached to said grinder base;

said grinder base defines an insert contacting surface for contacting said grinder insert when said grinder insert is attached to said grinder base;

said insert and base contacting surfaces together define an interengaging and substantially complementary tongue and groove combination for preventing slidable relative movement between insert and base contacting surfaces when said insert and base contacting surfaces are in abutting contact with each other.

39. A combination as recited in claim 38 wherein said tongue and groove combination includes a tongue extending from said base contacting surface and a corresponding groove formed in said insert contacting surface, said tongue and said groove being configured and sized so that said tongue is substantially fittingly inserted in said groove when said insert and base contacting surfaces are in abutting contact with each other.

40. A combination as recited in claim 39 wherein said tongue and groove both have a substantially parallelelpiped-shaped configuration.

41. A combination as recited in claim 38 wherein said tongue and groove combination allows said grinder insert to be positioned in at least two distinct orientation relative to said grinder base.

* * * * *